252-103 AU 166 EX
6/8/82 XR 4,333,844

United States Patent [19]

Duggleby et al.

[11] 4,333,844

[45] Jun. 8, 1982

[54] DETERGENT COMPOSITIONS

[75] Inventors: Peter M. Duggleby; Francis G. Foster, both of Wirral, England; Jacobus R. Nooi, Hellevoetsluis, Netherlands

[73] Assignee: Lever Brothers Company, New York, N.Y.

[21] Appl. No.: 203,172

[22] Filed: Nov. 3, 1980

[30] Foreign Application Priority Data

Nov. 12, 1979 [GB] United Kingdom ..... 7939123

[51] Int. Cl.[3] ..... C11D 7/54

[52] U.S. Cl. ..... 252/97; 252/95; 252/96; 252/98; 252/99; 252/103

[58] Field of Search ..... 252/96, 97, 98, 99, 252/103, 95

[56] References Cited

U.S. PATENT DOCUMENTS 3,415,752 12/1968 Reeves et al. ..... 252/96
3,684,723 8/1972 Best et al. ..... 252/96

*Primary Examiner*—Mayer Weinblatt
*Attorney, Agent, or Firm*—Melvin H. Kurtz

[57] ABSTRACT

A particulate alkaline detergent composition is disclosed which is suitable for washing fabrics and exhibiting good detergency, stability and bleaching while the level of inorganic material deposited on the fabrics is at an acceptably low level. The composition comprises a synthetic detergent active, a mixture of tripolyphosphate and orthophosphate in the ratio of 20:1 to 3:1 and a mixture of a peroxygen bleach such as perborate and a bleach activator such as tetraacetylethylenediamine. The phosphates constitute from 10 to 40% of the composition while the bleach system constitutes from 5 to 30%. The amount of pyrophosphate, if any, should be kept below 5%. Soap may be added to the composition. The compositions may be prepared by mixing the bleach system and optionally the alkali metal phosphate with a spray dried powder containing the remaining constituents.

10 Claims, No Drawings

DETERGENT COMPOSITIONS

TECHNICAL FIELD

The invention concerns detergent compositions which are particularly adapted for fabric washing, and specifically with such compositions which are based on phosphate detergency builders together with optimised bleach systems.

BACKGROUND ART

It is known to provide alkaline detergent compositions containing synthetic detergent compounds with a builder system comprising a mixture of an alkali metal tripolyphosphate and an alkali metal orthophosphate. Thus, detergent compositions comprising mixed phosphate builders systems based on mixed tripolyphosphate and orthophosphate have been disclosed in British Pat. No. 1,530,799. These compositions comprise from 5% to 30% of a synthetic anionic, nonionic, amphoteric or zwitterionic detergent compound or a mixture thereof, and from 10% to 30% of mixed alkalimetal tripolyphosphate and alkalimetal orthophosphate in the ratio of from 10:1 to 1:5 parts by weight, wherein the amount of alkalimetal tripolyphosphate is at least 5%, and the amount of any alkalimetal pyrophosphate is not more than 5%, all these percentages being by weight of the total detergent composition, and the pH of a 0.1% aqueous solution of the composition is from 9 to 11.

It is also known to provide alkaline detergent compositions with an activated peroxygen bleach system comprising a mixture of a peroxygen bleach compound together with an activator therefor. Thus, British Pat. No. 1,398,785 discloses a composition in which the bleaching system comprises a mixture of, for example, sodium perborate and tetraacetylglycoluril.

DISCLOSURE OF THE INVENTION

We have now discovered that in a composition containing a tripolyphosphate-orthophosphate builder system and an activated peroxygen bleach system, optimum performance can be obtained by selecting the proportions of the various components of the composition between certain limits.

Thus according to the invention there is provided a particulate alkaline detergent composition for fabric washing comprising from about 5% to about 40% by weight of at least one synthetic detergent compound, a builder system comprising a mixture of an alkalimetal tripolyphosphate and an alkalimetal orthophosphate and an activated peroxygen bleach system comprising a mixture of a peroxy bleach compound together with an activator therefor, characterised in that the alkalimetal tripolyphosphate and the alkalimetal orthophosphate are present in a weight ratio of between about 20:1 and about 3:1 and constitute from about 10% to about 40% by weight of the composition and in that the activated bleach system constitutes from about 5% to about 30% by weight of the composition.

The detergent compositions of the present invention are particularly beneficial in providing good detergency and bleaching properties at decreased phosphate builder levels. In particular, the activated bleach systems which are particularly effective at providing good bleaching action at low wash temperatures, appear to be substantially compatible with the mixed phosphate builder system employed, both during storage and in the wash despite the higher alkalinity caused by the builder systems. The latter in turn appears not to be inhibited appreciably by the presence of the activated bleach system components. The overall result is therefore a product having a good general wash performance under modern wash conditions, but with a decreased phosphate potential in response to controls on the levels of phosphate usage in detergent products.

We have now found it advantageous to employ the alkalimetal tripolyphosphate and alkalimetal orthophosphate in the ratio of from about 20:1 to about 3:1 parts by weight, as these ratios have been found to give the optimum detergency performance overall in relation to the phosphate content. In particular these builder mixtures have a reduced tendency to form inorganic deposits during the wash.

BEST MODE OF CARRYING OUT INVENTION

The alkalimetal orthophosphate used is either potassium or preferably sodium orthophosphate, as the latter is cheaper and more readily available. Normally the tri-alkali metal salts are used, but orthophosphoric acid or the di- or mono-alkali metal salts, e.g. disodium hydrogen orthophosphate or monosodium dihydrogen orthophosphate could be used if desired to form the compositions. In the latter event other more alkaline salts would also be present to maintain a high pH in the end product. The use of a mixture of the monosodium and disodium hydrogen orthophosphates in the ratio of 1:3 to 2:3, especially about 1:2, is particularly advantageous, as such a mixture is made as a feedstock for the production of sodium tripolyphosphate and is therefore readily available. Both the alkalimetal orthophosphate and the sodium tripolyphosphate can be used initially as the anhydrous or hydrated salts, for example as trisodium orthophosphate dodecahydrate and pentasodium tripolyphosphate hexahydrate, but hydration normally takes place during detergent powder production. The amounts of the salts are, however, calculated in anhydrous form. The alkalimetal tripolyphosphate used is either potassium or preferably sodium tripolyphosphate, the former being more expensive.

Whilst the ratio of the alkalimetal tripolyphosphate to the alkalimetal orthophosphate can be varied from about 20:1 to about 3:1 parts by weight, it is preferred to have a ratio of about 15:1 to about 5:1.

It will be appreciated that the actual amounts of alkali metal tripolyphosphate and alkali metal orthophosphate are chosen according to the overall phosphate detergency builder level which is desired in the detergent compositions or according to the maximum permitted phosphorus content. Within the requirements of a total alkali metal tripolyphosphate and alkali metal orthophosphate level of about 10% to about 40% by weight of the product, it is generally preferable to have an alkali metal tripolyphosphate content of from about 15% to about 30%, especially about 20% to about 25%, and an alkali metal orthophosphate content of from about 1% to about 10%, especially about 2% to about 5%, by weight of the product. The total amount of alkali metal tripolyphosphate and alkali metal orthophosphate is preferably from about 15% to about 30% by weight of the composition. Preferably the total amount of all phosphate materials present in the detergent compositions is not more than about 30% by weight of the compositions.

It is preferable that the only phosphate detergency builders used to make the compositions of the invention should be the alkali metal tripolyphosphate and alkali metal orthophosphate. In particular, it is desirable to add no alkali metal, i.e. sodium or potassium, pyrophosphates to the compositions as they tend to increase inorganic deposition. However, low levels, ie up to about 5% of sodium pyrophosphate may be found in spray dried powders due to the hydrolysis of sodium tripolyphosphate under the hot alkaline conditions met during conventional spray drying. To minimise the formation of alkali metal pyrophosphate by hydrolysis of the tripolyphosphate in spray-drying it is particularly preferred to postdose at least some of the tripolyphosphate to the detergent base powder made with the other ingredients, normally by spray-drying. Such a process is described in our European patent application No. 79302057.9. The detergent compositions of the invention necessarily include from about 5% to about 40%, preferably about 10% to about 25%, by weight of a synthetic anionic, nonionic, amphoteric or zwitterionic detergent compound or mixture thereof. Many suitable detergent compounds are commercially available and are fully described in the literature, for example in "Surface Active Agents and Detergents," Volumes I and II, by Schwartz, Perry and Berch.

The preferred detergent compounds which can be used are synthetic anionic and nonionic compounds. The former are usually water soluble alkali metal salts of organic sulphates and sulphonates having alkyl radicals containing from about 8 to about 22 carbon atoms, the term alkyl being used to include the alkyl portion of higher aryl radicals. Examples of suitable synthetic anionic detergent compounds are sodium and potassium alkyl sulphates, especially those obtained by sulphating higher ($C_8$–$C_{18}$) alcohols produced for example from tallow or coconut oil; sodium and potassium alkyl ($C_9$–$C_{20}$) benzene sulphonates, particularly sodium linear secondary alkyl ($C_{10}$–$C_{15}$) benzene sulphonates; sodium alkyl glyceryl ether sulphates, especially those ethers of the higher alcohols derived from tallow or coconut oil and synthetic alcohols derived from petroleum; sodium coconut oil fatty acid monoglyceride sulphates and sulphonates; sodium and potassium salts of sulphuric acid esters of higher ($C_9$–$C_{18}$) fatty alcohol-alkylene oxide, particularly ethylene oxide, reaction products; the reaction products of fatty acids such as coconut fatty acids esterified with isethionic acid and neutralised with sodium hydroxide; sodium and potassium salts of fatty acid amides of methyl taurine; alkane monosulphonates such as those derived by reacting alpha-olefins ($C_8$–$C_{20}$) with sodium bisulphate and those derived by reacting paraffins with $SO_2$ and $Cl_2$ and then hydrolysing with a base to produce a random sulphonate; and olefin sulphonates, which term is used to described the material made by reacting olefins, particularly $C_{10}$–$C_{20}$ alpha-olefins, with $SO_3$ and then neutralising and hydrolysing the reaction product. The preferred anionic detergent compounds are sodium ($C_{11}$–$C_{15}$) alkyl benzene sulphonates and sodium ($C_{16}$–$C_{18}$) alkyl sulphates.

Examples of suitable nonionic detergent compounds which may be used include in particular the reaction products of alkylene oxides, usually ethylene oxide, with alkyl ($C_6$–$C_{22}$) phenols, generally 5 to 25 EO, i.e. 5 to 25 units of ethylene oxide per molecule; the condensation products of aliphatic ($C_8$–$C_{18}$) primary or secondary linear or branched alcohols with ethylene oxide, generally 6 to 30 EO, and products made by condensation of ethylene oxide with the reaction products of propylene oxide and ethylenediamine. Other so-called nonionic detergent compounds include long chain tertiary amine oxides, long chain tertiary phosphine oxides and dialkyl sulphoxides.

Mixtures of detergent compounds, for example mixed anionic or mixed anionic and nonionic compounds may be used in the detergent compositions, particularly in the latter case to provide controlled low sudsing properties. This is beneficial for compositions intended for use in suds-intolerant automatic washing machines. The presence of some nonionic detergent compounds in the compositions may also help to decrease the tendency of insoluble phosphate salts to deposit on the washed fabrics.

Amounts of amphoteric or zwitterionic detergent compounds can also be used in the compositions of the invention but this is not normally desired due to their relatively high cost. If any amphoteric or zwitterionic detergent compounds are used it is generally in small amounts in compositions based on the much more commonly used synthetic anionic and/or nonionic detergent compounds. For example, mixtures of amine oxides and ethoxylated nonionic detergent compounds can be used.

Some soaps may also be used in the compositions of the invention, but not as the sole detergent compounds. They are particularly useful at low levels in binary or ternary mixtures together with nonionic or mixed synthetic anionic and nonionic detergent compounds, which have low sudsing properties. The soaps which are used may be the sodium, or less desirably potassium, salts of $C_{10}$–$C_{24}$ fatty acids. It is particularly preferred that the soaps should be based mainly on the longer-chain fatty acids within this range, that is with at least half of the soap having a carbon chain length of 16 or over. This is most conveniently accomplished by using soaps from natural sources such as tallow, palm oil or rapeseed oil, which can be hardened if desired, with lesser amounts of other shorter-chain soaps, prepared from nut oils such as coconut oil or palm kernel oil. The amount of such soaps can be varied between about 0.5% and about 25% by weight, with lower amounts of about 0.5% to about 5% being generally sufficient for lather control. Amounts of soap between about 2% and about 20%, especially between about 5% and about 15%, are preferably used to give a beneficial effect on detergency. This is particularly valuable in compositions used in hard water when the soap acts as a supplementary builder. In addition, we have found that the addition of soap helps to decrease the tendency of the compositions to form inorganic deposits in the wash, for which purpose it is preferred to use about 2% to about 15%, especially about 2.5% to about 10% by weight of soap in the compositions.

The bleach system used essentially comprises a peroxy bleach compound which is an inorganic persalt, and an activator therefor. The activator makes the bleaching more effective at lower temperatures, i.e. in the range from ambient temperature to about 60° C., so that such bleach systems are commonly known as low-temperature bleach systems and are well known in the art. The inorganic persalt such as sodium perborate, acts to release active oxygen in solution, and the activator therefore is usually an organic compound having one or more reactive acyl residues, which cause the formation of peracids, the latter providing for a more effective bleaching action at lower temperatures than the peroxy-bleach compound. The ratio by weight of the peroxy bleach compound to the activator is generally from about 20:1 to about 1:1, preferably about 10:1 to about 2:1.

Whilst the amount of the bleach system, i.e. peroxy bleach compound and activator may be varied between about 5% and about 30% by weight of the detergent compositions, it is preferred to use about 10% to about 25% of the ingredients forming the bleach system.

Typical examples of suitable peroxybleach compounds are alkalimetal perborates, both tetrahydrates and monohydrates, alkali metal percarbonates, persilicates and perphosphates, of which sodium perborate is preferred. The peroxybleach compound is normally added in granular form to the detergent base powder, and it is desirable to avoid segregation by having the particles of both of generally the same order.

Activators for peroxybleach compounds have been amply described in the literature, including British Pat. Nos. 836,988, 855,735, 907,356, 907,358, 970,950, 1,003,310 and 1,246,339, U.S. Pat. Nos. 3,332,882 and 4,128,494, Canadian Pat. No. 844,481 and South African Pat. No. 68/6,344. Specific suitable activators include:

(a) N-diacylated and N,N'-polyacylated amines, such as N,N,N',N'-tetraacetyl methylene diamine and N,N,N',N'-tetraacetyl ethylene diamine, N,N-diacetylaniline, N,N-diacetyl-p-toluidine; 1,3-diacylated hydantoins such as, for example, 1,3-diacetyl-5,5-dimethyl hydantoin and 1,3-dipropionyl hydantoin; α-acyloxy-(N,N')-polyacylmalonamide, for example α-acetoxy-(N,N')-diacetylmalonamide;

(b) N-alkyl-N-sulphonyl carbonamides, for example the compounds N-methyl-N-mesyl-acetamide, N-methyl-N-mesyl-benzamide, N-methyl-N-mesyl-p-nitrobenzamide, and N-methyl-N-mesyl-p-methoxybenzamide;

(c) N-acylated cyclic hydrazides, acylated triazoles or urazoles, for example monoacetylmaleic acid hydrazide;

(d) O,N,N-trisubstituted hydroxylamines, such as O-benzoyl-N,N-succinyl hydroxylamine, O-acetyl-N,N-succinyl hydroxylamine, O-p-methoxybenzoyl-N,N-succinyl-hydroxylamine, O-p-nitrobenzoyl-N,N-succinyl-hydroxylamine and O,N,N-triacetyl hydroxylamine;

(e) N,N'-diacyl-sulphurylamides, for example N,N'-dimethyl-N,N'-diacetyl-sulphurylamide and N,N'-diethyl-N,N'-dipropionyl sulphurylamide;

(f) Triacylcyanurates, for example triacetyl cyanurate and tribenzoyl cyanurate;

(g) Carboxylic acid anhydrides, such as benzoic anhydride, m-chloro-benzoic anhydride, phthalic anhydride, 4-chloro phthalic anhydride;

(h) Sugar esters, for example glycose pentaacetate;

(i) 1,3-diacyl-4,5-diacyloxy-imidazolidine, for example 1,3-diformyl-4,5-diacetoxy-imidazolidine, 1,3-diacetyl-4,5-diacetoxy-imidazolidine, 1,3-diacetyl-4,5-dipropionyloxy-imidazoline;

(j) Tetraacetylglycoluril and tetrapropionylglycoluril;

(k) Diacylated 2,5-diketopiperazine, such as 1,4-diacetyl-2,5-diketopiperazine, 1,4-dipropionyl-2,5-diketopiperazine and 1,4-dipropionyl-3,6-dimetyl-2,5-diketopiperazine;

(l) Acylation products of propylenediurea or 2,2-dimethylpropylenediurea (2,4,6,8-tetraaza-bicyclo-(3,3,1)-nonane-3,7-dione or its 9,9-dimethyl derivative), especially the tetraacetyl- or the tetrapropionyl-propylenediurea or their dimethyl derivatives;

(m) Carbonic acid esters, for example the sodium salts of p-(ethoxycarbonyloxy)-benzoic acid and p-(propoxycarbonyloxy)-benzenesulphonic acid.

The N-diacylated and N,N'-polyacylated amines mentioned under (a) are of special interest, particularly N,N,N',N'-tetraacetyl-ethylenediamine (TAED).

It is preferred to use the activator in granular form, preferably wherein the activator is finely divided as described in our UK patent application No. 7,923,765. Specifically, it is preferred to have an activator of an average particle size of less than 150 micrometers, which gives significant improvement in bleach efficiency. The sedimentation losses, when using an activator with an average particle size of less than 150 μm, are substantially decreased. Even better bleach performance is obtained if the average particle size of the activator is less than 100 μm. However, too small a particle size gives increased decomposition, dust-formation and handling problems, and although particle sizes below 100 μm can provide for an improved bleaching efficiency, it is desirable that the activator should not have more than 50% by weight of particles with a size of less than 30 μm. On the other hand, the activator may have a certain amount of particles of a size greater than 150 μm, but it should not contain more than 5% by weight of particles >300 μm, and not more than 20% by weight of particles >200 μm, preferably >150 μm. It is to be understood that these particle sizes refer to the activator present in the granules, and not to the granules themselves. The latter have a particle size, the major part of it ranging from 100 to 1000 μm, preferably 500 to 900 μm. Up to 5% by weight of granules with a particle size of >1000 μm is tolerable.

The granules incorporating the activator, preferably in this finely-divided form, may be obtained by granulating a suitable carrier material, such as sodium tripolyphosphate and/or potassium tripolyphosphate with activator particles of the required size. Other granulation methods, e.g. using organic and/or inorganic granulation aids, can also be usefully applied. The granules can be subsequently dried, if required. Basically, any granulation process is applicable, as long as the granule contains the activator, and as long as the other materials present in the granule do not negatively affect the activator.

Apart from the detergent compounds, detergency builders and the peroxy bleach system, the detergent compositions of the invention can contain any of the conventional additives in the amounts in which such materials are normally employed in fabric washing detergent compositions. Examples of these additives include lather boosters such as alkanolamides, particularly the monoethanolamides derived from palm kernel fatty acids and coconut fatty acids, lather depressants such as alkyl phosphates and silicones, anti-redeposition agents such as sodium carboxymethylcellulose and polyvinyl pyrrolidone, stabilisers for the activators in the bleach system, fabric softening agents, inorganic salts such as sodium sulphate and sodium carbonate, and, usually present in very minor amounts, fluorescent agents, perfumes, enzymes such as proteases and amylases, germicides and colourants.

It is particularly preferred to include in the detergent compositions a stabiliser for the bleach activator, for example ethylene diamine tetramethylene phosphonate and diethylene triamine pentamethylene phosphonate. These activators can be used in acid or salts form, especially in calcium, magnesium, zinc or aluminum salt form, as described in our U.K. patent application No. 7,912,141.

It is desirable to include one or more antideposition agents in the detergent compositions of the invention, to decrease a tendency to form inorganic deposits on washed fabrics. The amount of any such antideposition agent is normally from about 0.1% to about 5% by weight, preferably from about 0.2% to about 2.5% by weight of the composition. The preferred antideposition agents are anionic polyelectrolytes, especially polymeric aliphatic carboxylates, or organic phosphonates.

These materials appear to be effective by stabilising insoluble calcium orthophosphate particles in suspension. The anionic polyelectrolytes can readily be tested to determine their effectiveness as antideposition agents in a detergent composition by measuring the level of inorganic deposits on fabric washed with and without the anionic polyelectrolyte being present.

Examples of suitable antideposition agents are homo- and copolymers of acrylic acid or substituted acrylic acids, such as sodium polyacrylate, the sodium salt of copolymethacrylamide/acrylic acid and sodium poly-alpha-hydroxyacrylate, salts of copolymers of maleic anhydride with ethylene, acrylic acid and vinylmethylether or styrene, especially 1:1 copolymers and optionally with partial esterification of the carboxyl groups especially in the case of the styrene-maleic anhydride copolymers. Such copolymers preferably have relatively low molecular weights, e.g. in the range of about 5,000 to 50,000. Other antideposition agents include the sodium salts of polymaleic acid, polyitaconic acid and polyaspartic acid, phosphate esters of ethoxylated aliphatic alcohols, polyethylene glycol phosphate esters, and certain organic phosphonates such as sodium ethane-1-hydroxy-1, 1-diphosphonate, sodium 2-phosphonobutane tricarboxylate and sodium ethylene diamine tetramethylene phosphonate, which also functions as an activator stabiliser as mentioned above. Mixtures of organic phosphonic acids or substituted acrylic acids or their salts with protective colloids such as gelatin may also be used. The most preferred antideposition agent is sodium polyacrylate having a MW of about 10,000 to 50,000, for example about 27,000.

The use of such anionic polyelectrolytes together with some soap as a second antideposition agent is particularly beneficial. This enables good deposition control, whilst avoiding the use of excessive levels of either the anionic polyelectrolyte or the soap alone to control the inorganic deposition. Amounts of soap above about 10% can cause processing problems which require special measures to add the soap after spray-drying the detergent base powder, and amounts of the anionic polyelectrolytes over about 2.5% in the compositions are discouraged because of their poor biodegradability and high cost. Thus, by using the mixture of both soap and the anionic polyelectrolyte one can achieve good ash control in a technically feasible and economical manner.

It is also possible to include in the detergent compositions of the invention minor amounts, preferably not more than about 20% by weight, of other non-phosphate detergency builders, which may be either so-called precipitant builders or sequestrant builders. This is of particular benefit where it is desired to increase detergency whilst using particularly low levels of the essential alkali metal tripolyphosphate and alkali metal orthophosphate builders, so as to achieve low phosphorus contents in the detergent compositions. Examples of such other detergency builders are amine carboxylates such as sodium nitrilotriacetate, crystalline or amorphous sodium aluminosilicate ion-exchange materials, sodium alkenyl succinate and malonates, sodium carboxymethyloxysuccinate, sodium citrate and soap. However, such other builder materials are not essential and it is a particular benefit of the compositions of the invention that satisfactory detergency building properties can be achieved with only phosphate builders at lower levels than hitherto considered necessary.

It is also desirable to include in the compositions an amount of an alkali metal silicate, particularly sodium ortho-, meta- or preferably neutral or alkaline silicate. The presence of such alkali metal silicates at levels of at least about 1%, and preferably from about 5% to about 15% by weight of the compositions, is advantageous in decreasing the corrosion of metal parts in washing machines, besides giving processing benefits and generally improved powder properties. The more highly alkaline ortho- and metasilicates would normally only be used at lower amounts within this range, in admixture with the neutral or alkaline silicates.

The compositions of the invention are required to be alkaline, but not too strongly alkaline as this could result in fabric damage and also be hazardous for domestic usage. In practice the compositions should give a pH of from about 8.5 to about 11 in use in aqueous wash solution. It is preferred in particular for domestic products to have a pH of from about 9.0 to about 10.5 as lower pHs tend to be less effective for optimum detergency building, and more highly alkaline products can be hazardous if misused. The pH is measured at the lowest normal usage concentration of 0.1% w/v of the product in water of 12° H (Ca), (French permanent hardness, calcium only) at 50° C. so that a satisfactory degree of alkalinity can be assured in use at all normal product concentrations.

The pH is controlled by the amount of alkali metal orthophosphate and any other alkaline salts such as alkali metal silicate, sodium perborate and sodium carbonate, the amount of the latter preferably being not more than 20% by weight of the composition. The presence of other alkaline salts, especially the alkali metal silicates, is particularly beneficial because the alkalinity of the alkali metal orthophosphates is diminished in hard water due to precipitation of the calcium salt. The other ingredients in the alkaline detergent compositions of the invention should of course be chosen for alkaline stability, especially for pH-sensitive materials such as enzymes.

The detergent compositions of the invention should be in free-flowing particulate, eg powdered or granular form, and can be produced by any of the technique commonly employed in the manufacture of such fabric washing compositions, but preferably by slurry making and spray drying processes to form a detergent base powder to which the ingredients of the bleach system, and optionally also the alkali metal tripolyphosphate are added. It is preferred that the process used to form the compositions should result in a product having a moisture content of not more than about 12%, more preferably from about 4% to about 10% by weight, as the lower moisture levels have been found to be beneficial for stability of the bleach systems employed.

The compositions of the invention as illustrated by the following Example in which parts and percentages are by weight, and amounts are expressed on an anhydrous basis except where otherwise indicated.

EXAMPLE

A particulate detergent composition was made to the following nominal formulation and found to have excellent properties. In particular the composition is found to exhibit good detergency, stability and bleaching while the level of inorganic material deposited on the fabrics is at an acceptably low level.

| Ingredient | % |
|---|---|
| Sodium alkyl benzene sulphonate | 6.5 |
| Nonionic compounds $C_{12}$—12 EO and 18 EO | 3.0 |
| Soap (predominantly $C_{16}$-$C_{22}$) | 5.0 |
| Sodium tripolyphosphate[1] | 23.00 |
| Sodium orthophosphate | 2.0 |
| Sodium carboxymethyl cellulose | 1.0 |
| Sodium alkaline silicate | 6.0 |
| Sodium sulphate | 20.0 |
| Sodium perborate | 20.0 |
| Tetraacetyl ethylene diamine[2] | 2.5 |
| Ethylene diamine tetramethylphosphonate | 0.4 |
| Proteolytic Enzyme granules | 0.5 |
| Water and minor ingredients to | 100 |

[1]Hydrolysis during powder processing resulted in a total tripolyphosphates content in the final product of about 20.0% with a corresponding increase in orthophosphate content to about 2.5% and the formation of about 1.5% sodium pyrophosphate.
[2]The activator was granulated with some of the sodium tripolyphosphate and postdosed with the sodium perborate to a spray-dried base powder containing the other ingredients.

In comparison with the above composition, a change in the ratio of tripolyphosphate to orthophosphate to more than about 20:1 or to less than about 3:1 would be found to increase the amount of inorganic material deposited on the fabrics while a reduction in the total amount of tripolyphosphate and orthophosphate to a total of less than about 10% would be found to lead to reduced building and reduced detergency.

EXAMPLE 2

Detergent base powders were prepared by spray drying a slurry to give compositions approximately according to the following formulations.

| | A | B | C | D | E | F | G |
|---|---|---|---|---|---|---|---|
| Anionic synthetic detergent active | 9 | 8 | 8 | 8 | 8 | 9 | 10 |
| Nonionic synthetic detergent active | 3 | 3 | 6 | 3 | 3 | 4 | 5 |
| Soap | 4 | 4 | — | 4 | 6 | 7 | 8 |
| Sodium silicate | 15 | 9 | 7 | 7 | 7 | 8 | 10 |
| Sodium tripolyphosphate | — | 46 | 30 | 30 | 30 | 30 | — |
| (Sodium tripolyphosphate after spray drying) | (12) | (40) | (25) | (25) | (25) | (26) | (16) |
| Sodium orthophosphate | 9 | — | 3 | 3 | 3 | 3 | 3 |
| (Sodium orthophosphate after spray drying) | (9) | (1) | (4) | (4) | (4) | (3) | (3) |
| (Sodium pyrophosphate after spray drying) | (—) | (5) | (4) | (4) | (4) | (3) | (—) |
| Minor ingredients water and salts | | | balance to 100 | | | | |

In formulations A and G, the STP was post-dosed to the powder obtained by spray drying a slurry of the remaining components. To each of these base powders was then added a peroxygen bleach, an activator and a stabiliser to give a final product containing overall 15% sodium perborate tetrahydrate (ex Air Liquid), 2% TAED and 0.3% Dequest 2041 (ex Monsanto). Using these products at a concentration of 6 g/l in water having a hardness of 15° GH, the concentrations of peracetic acid, hydrogen peroxide and active oxygen were determined using known methods, and this data was used to determine a bleach system instability factor for each product. The temperature profile of each test consisted of a heat-up frpm 20° C. to 60° C. in 25 minutes followed by 25 minutes held at 60° C. The results achieved are shown in the following table.

| Product: | A | B | C | D | E | F | G |
|---|---|---|---|---|---|---|---|
| Bleach system instability factor | 7.6 | 0.7 | 3.0 | 2.2 | 2.5 | 3.7 | 3.4 |

These results demonstrate that the bleach system stability of products C to G, which fall within the present invention are superior to that of product A where the STP:ortho ratio (approximately 1.3:1) lies outside the scope of the present invention. Product B is included to show the performance of a high phosphorus, STP only system.

We claim:

1. A particulate alkaline detergent composition for fabric washing consisting essentially of about 5% to about 40% by weight of at least one synthetic detergent compound, a builder system comprising a mixture of alkalimetal tripolyphosphate and an alkalimetal orthophosphate and an activated peroxygen bleach system comprising a mixture of a peroxy bleach compound in the form of an inorganic persalt together with an activator therefor, wherein said alkalimetal tripolyphosphate and the alkalimetal orthophosphate are present in a weight ratio of about 20:1 to about 3:1, and constitute about 5% to about 30% by weight of the composition.

2. A composition according to claim 1, wherein said alkalimetal tripolyphosphate and the alkalimetal orthophosphate are present in a weight ratio of about 15:1 to about 5:1 and constitute about 15% to about 30% by weight of the composition.

3. A composition according to claim 1, wherein not more than about 5% by weight of alkalimetal pyrophosphate is present.

4. A composition according to claim 1, wherein said composition further comprises about 2% to about 20% by weight of soap.

5. A composition according to claim 1, wherein about 4% to about 10% by weight of water is present.

6. A method of forming a particulate alkaline detergent composition useful for fabric washing consisting essentially the steps of mixing together about 5% to about 40% by weight of at least one synthetic detergent compound, about 5% to about 30% by weight of an activated bleach system comprising a mixture of a peroxy bleach compound in the form of an inorganic persalt and an activator therefor, and about 10% to about 40% by weight of a mixture of an alkalimetal tripolyphosphate and an alkalimetal orthophosphate in a weight ratio of about 20:1 and 3:1.

7. A method according to claim 6, further comprising:

(i) forming a slurry of at least the synthetic detergent compound and the alkalimetal orthophosphate;

(ii) spray drying the slurry formed in step (i) to form a base powder; and (iii) subsequently mixing with the base powder formed in step (ii) the peroxy bleach compound and the activator thereof.

8. A method according to claim 7, further comprising the step of mixing the alkalimetal tripolyphosphate with the base powder formed in step (ii).

9. A method according to claim 6 or 7, wherein the weight ratio of said peroxy bleach comound to said activator is about 20:1 to about 1:1.

10. A composition according to claim 1, wherein the weight ratio of said peroxy bleach compound to said activator is about 20:1 to about 1:1.

* * * * *